United States Patent [19]

Rieland

[11] 4,391,348

[45] Jul. 5, 1983

[54] SCAFFOLD SAFETY PIN

[76] Inventor: Ronald L. Rieland, 963 S. Orient Ave., Fairmont, Minn. 56031

[21] Appl. No.: 302,843

[22] Filed: Sep. 16, 1981

[51] Int. Cl.[3] ..... E04G 5/08; E04G 1/15

[52] U.S. Cl. ..... 182/119; 182/179; 182/222

[58] Field of Search ..... 182/222, 223, 119, 118, 182/120, 121, 122, 179, 178

[56] References Cited

U.S. PATENT DOCUMENTS

| | | | |
|---|---|---|---|
| 771,619 | 10/1904 | Foote | 292/284 |
| 2,268,050 | 12/1941 | McIntosh | 182/112 |
| 2,656,223 | 10/1953 | Gray | 182/119 |
| 2,665,951 | 1/1954 | Bobst | 182/222 |
| 2,835,538 | 5/1958 | Kornely | 182/142 |
| 3,135,351 | 6/1964 | Economos | 182/119 |
| 3,186,512 | 6/1965 | Johnson | 182/119 |
| 3,213,964 | 10/1965 | Tucker | 182/119 |
| 3,272,284 | 9/1966 | Lincoln | 182/222 |
| 3,330,585 | 7/1967 | Pollin | 292/164 |
| 3,563,586 | 2/1971 | Creamer | 292/144 |
| 3,854,552 | 12/1974 | Kensrue | 182/222 |
| 4,187,929 | 2/1980 | Cyr | 182/222 |

FOREIGN PATENT DOCUMENTS

| | | | |
|---|---|---|---|
| 2485598 | 12/1981 | France | 182/222 |

*Primary Examiner*—Reinaldo P. Machado

*Attorney, Agent, or Firm*—Merchant, Gould, Smith, Edell, Welter & Schmidt

[57] ABSTRACT

A scaffold is disclosed having a platform and at least a pair of generally horizontally extending, spaced support members beneath the platform. A pair of longitudinally spaced openings are formed in the platform through one surface to extend generally perpendicular thereto. A hollow cylinder is mounted in each opening having a pin mounted therein for movements between a retracted position and an extended, operative position. The platform can be disposed on the support members with the pins in the operative positions to prevent the platform from sliding off the support members, and the platform can be turned over to move the pins to the retracted positions for transport and storage purposes.

9 Claims, 5 Drawing Figures

FIG. 1
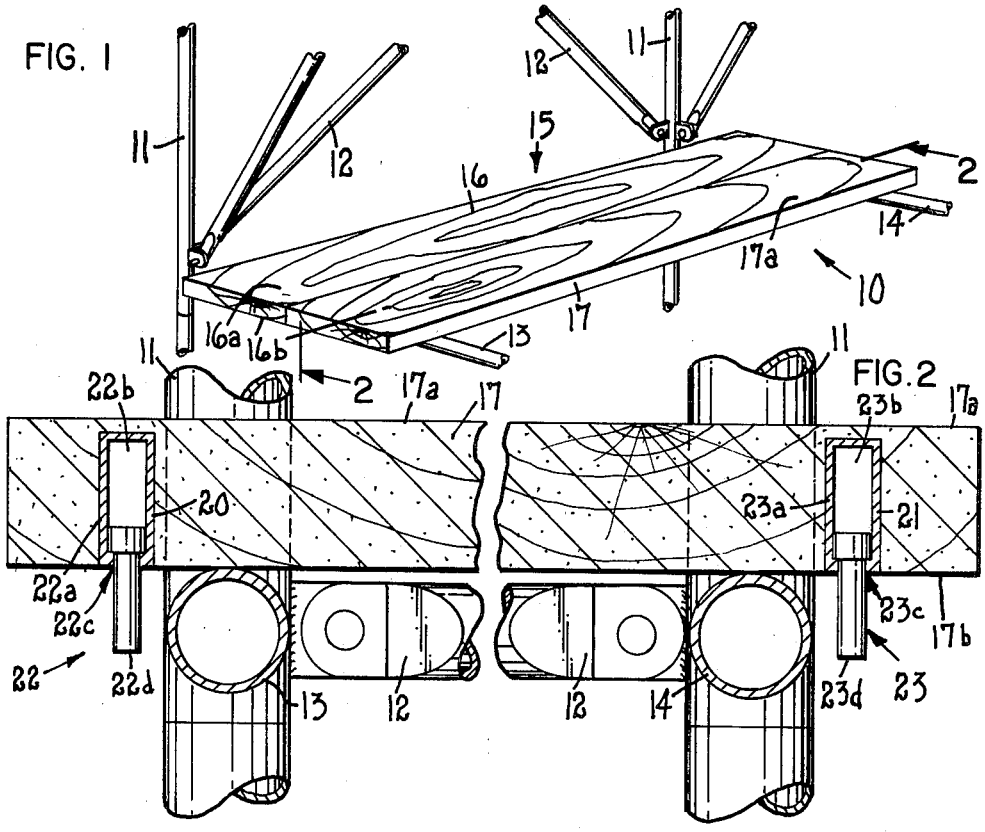
FIG. 2
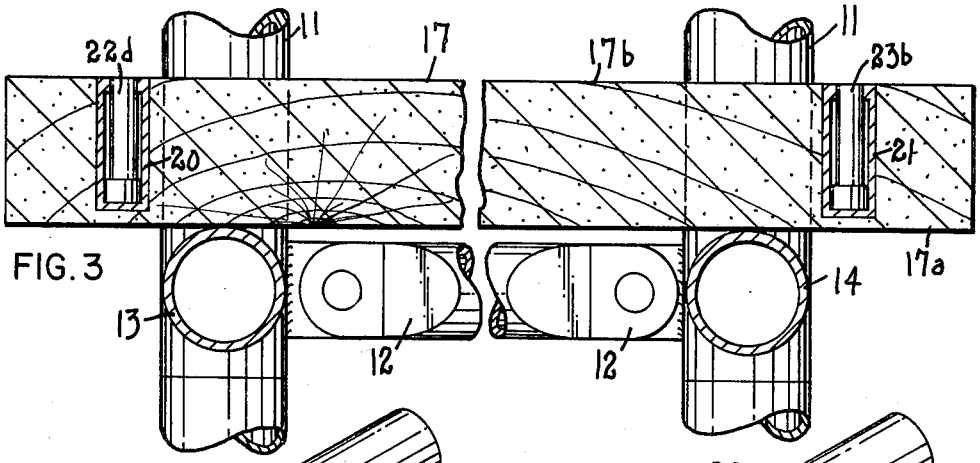
FIG. 3
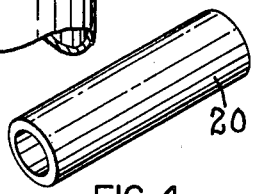
FIG. 4
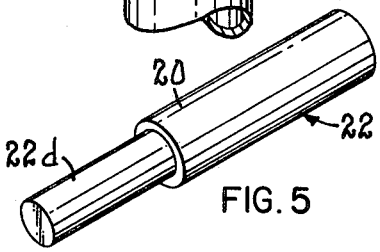
FIG. 5

SCAFFOLD SAFETY PIN

This invention relates generally to safety apparatus for scaffolds, and more particularly relates to a gravity-actuated locking pin which is adapted to extend from the plank surface to prevent the scaffold plank from sliding with respect to the associated framework and which can be retracted for stacking purposes by simply inverting the plank.

BACKGROUND OF THE INVENTION

Scaffolds are commonly used by carpenters, painters and the like to gain access to the walls of buildings and other structures. Scaffolds can be supported by a framework extending from the ground or attached to the building wall, or can be suspended on ropes or cables using scaffold hangers or bails. The scaffold platform may include a plurality of planks typically ten to fourteen feet in length, about two inches thick and either eight, ten or twelve inches in width. In some cases the planks are connected together by cross members or the like but in many cases the planks are placed side-by-side on the supporting framework but are not connected. A scaffold platform can also be constructed as a single unitary assembly, from commonly available material such as 2"×4" boards. Regardless of the construction, scaffold platforms are of a length, width and strength to safely accommodate one or more workers above the ground.

The scaffold platform is typically supported by a pair of spaced, generally horizontally extending support members. The support members can be of various constructions, including wooden bars, tubular metal structures or metal hangers. The size and spacing of the support members will depend upon the application, but at least two spaced support members are normally required to support the scaffold platform.

In the prior art, cleats have sometimes been nailed to the bottom sides of the scaffold planks at the ends to prevent them from sliding off the support members. In other cases, the scaffold platform has been secured to the cross members by ropes or wire. The Kornely U.S. Pat. No. 2,835,538 discloses a clamp which can be used to lock a scaffold platform to a supporting bail. These prior art techniques for preventing the platform from sliding with respect to the support members have not been satisfactory in all respects. The cleats are not convenient because they tie the planks together and interfere with moving and storing the planks. The use of ropes or the like is not only inconvenient but sometimes dangerous. A clamp of the type disclosed in the Kornely patent may not be useful with all scaffold constructions, is rather complicated and inconvenient to use, and is easily lost or misplaced when not in use. Thus, the prior art has not provided a simple and convenient method of preventing dangerous slippage between the scaffold platform and the supporting members.

SUMMARY OF THE INVENTION

The present invention provides safety apparatus for a scaffold having a platform and at least a pair of generally horizontally extending support members beneath the platform which are spaced a distance apart. The platform has opposing surfaces and a pair of openings are formed in the platform through one surface, with the openings extending generally normal to the surface. A safety pin means is mounted within each opening which comprises a hollow cylinder having a pin freely mounted therein for movement between a retracted position with respect to the one surface and an operative position extending out of the opening beyond the one surface such that with the platform disposed with the one surface facing downwardly the pins are moved by gravity to the operative positions to prevent the platform from sliding off the support members, and with the platform disposed with the one surface facing upwardly the pins are moved by gravity to the retracted positions.

The present invention thus permits the user to simply insert at least a pair of the safety pins in the platform, or in the individual planks forming the platform, such that sliding movements of the plank in either direction will cause one of the pins to engage a support member thereby preventing the platform or planks from sliding off the support members. When it is necessary to move or store the platform, which again may comprise a single unitary member or a plurality of planks, it is only necessary to turn the platform upside down to cause the pins to become retracted into the platform where they do not interfere with handling or storage of the platform. Once installed, the safety pins become an integral part of the platform and are automatically extended or retracted simply by turning the platform.

BRIEF DESCRIPTION OF THE DRAWINGS

FIG. 1 is a view in perspective of a typical scaffold arrangement including the safety pin means of the present invention, portions thereof being broken away;

FIG. 2 is a cross-sectional view on an enlarged scale taken along line 2—2 of FIG. 1, portions thereof being broken away;

FIG. 3 is a cross-sectional view similar to that of FIG. 2, with the platform inverted;

FIG. 4 is a view in perspective of a safety pin means with the pin retracted; and FIG. 5 is a view in perspective of a safety pin means with the pin in the operative, extended position.

DESCRIPTION OF THE PREFERRED EMBODIMENT

Referring now to the drawings, wherein like reference numerals are used throughout the several views to indicate like elements of the invention, there is disclosed in FIG. 1 a typical scaffold 10 including a tubular metal framework having vertically extending members 11 to provide support for the scaffold, a plurality of cross linking members 12, and a pair of horizontally extending support members 13, 14. The outwardly extending ends of members 13 and 14 would also be supported by suitable linkage, not shown. Supported by the horizontally extending members 13 and 14 is a platform 15, in this case comprising a pair of non-connected planks 16 and 17. As shown in the drawing, the two horizontally extending members 13 and 14 are typically positioned near the opposite ends of the platform 15 so that a person stepping on one end of the platform 15 will not cause it to tilt. The two planks 16, 17 have opposing surfaces, upper support surfaces 16*a*, 17*a* and downwardly facing surfaces 16*b*, 17*b*.

As shown in FIG. 2, plank 17 has a pair of longitudinally spaced openings 20 and 21 formed therein which extend through the lower surface 17*b* and extend generally normal or perpendicular to that surface. In the preferred embodiment, the openings 20 and 21 are cylindrical in shape having a circular cross section, and both openings terminate in a bottom wall short of support surface 17*a*.

Mounted in the openings 20, 21 are a pair of safety pin means 22, 23 each comprising an elongated hollow housing in the form of a hollow cylinder 22*a*, 23*a* each having an elongated axial bore 22*b*, 23*b* of a first diameter and an open end 22*c*, 23*c* of smaller diameter leading to the bore. The safety pin means 22, 23 are preferably press fit into the openings 20, 21 so that the open end is flush with the downwardly facing surface 17*b*.

A pair of pins 22*d*, 23*d* are mounted in the respective bores 22*b*, 23*b*, so as to be freely mounted therein for unrestricted movement between a retracted position with respect to the surface 17*b* and an operative, extended position extending out of the openings 22*c*, 23*c*, beyond the one surface 17*b*. The pins 22*d*, 23*d* each have an elongated shank portion corresponding in diameter to that of the open end of the corresponding housing, and a larger diameter end portion disposed within the bore of the housing. Thus, the larger diameter end portion of each pin forms a shoulder with respect to the shank portion which engages the end wall of the corresponding housing 22*a*, 23*a* which surrounds the corresponding opening 22*c*, 23*c* to prevent the pin from falling out of the housing. Therefore, with the plank 17 positioned with the surface 17*b* facing downwardly as shown in FIG. 2 the pins 22*d*, 23*d* are moved by gravitational forces to the operative positions shown in FIG. 2 wherein they are extended a sufficient distance to engage the adjacent support members 13, 14 if the plank 17 slides in either direction. In the preferred embodiment shown in the drawings, the safety pin means 22, 23 are spaced a distance apart slightly greater than the distance between the support members 13, 14 so that if the plank 17 slides in either direction, one of the extended pins will engage the corresponding support member. However, it should be noted that the two safety pin means 22, 23 could be located between and closely adjacent to the two horizontal support members 13, 14, or perhaps on both sides of and close to one support member, and still provide the same safety feature. In either case, the support member or members should be located closely adjacent the two pins or stop members 22, 23 so that the plank need slide only a short distance in either direction to make contact.

In FIG. 3, the plank 17 has been turned over so that the surface 17*b* faces upwardly. In this position, the stop members 22*d*, 23*d* are moved by gravity to the fully retracted positions as shown. It can be seen that the length of each pin 22*d*, 23*d* is equal to the combined lengths of the elongated shank portion and the larger diameter end portion of the pin, and that the combined length is equal to the length of the respective bore 22*b*, 23*b* and end opening 22*c*, 23*c*. In the retracted position, the end of the pin is preferably flush with the surface 17*b* but could also be a short distance below the surface. With the plank 17 in the position shown in FIG. 3, with the pins retracted, the plank can be easily handled, either by sliding it off the support members for transport to another location, or for transport or storage. Because the pins are retracted, they do not snag other planks or support members as the planks are being moved or stored.

Although the details of only one plank are shown in the drawings, it should be noted that a similar set of safety pin means would be mounted in the plank 16. Although it is sufficient to mount one safety pin means at the end of each plank, more than one could be located at each end, particularly for wider platforms. Although in the preferred embodiment shown, the two safety pin means are mounted outside of the two support members, they could be mounted inside as well, or a pair of safety pin means could be mounted on both sides of a single support member such as member 13. It can be seen that with the present invention, the safety pin means can be easily mounted in a scaffold platform to provide a safe environment for the user and to permit easy handling and storage of the platform.

What is claimed is:

1. Safety apparatus for scaffolds, comprising:

(a) a scaffold having a platform and at least a pair of generally horizontally extending support members beneath said platform spaced a first distance apart, said platform having opposing surfaces;

(b) a pair of openings in said platform through one surface extending generally normal to said one surface;

(c) safety pin means mounted within each said opening comprising a hollow cylinder having a pin freely mounted therein for limited movement between a retracted position with respect to said one surface and an operative position extending out of said opening beyond said one surface such that with said platform disposed with said one surface facing downwardly said pins are moved by gravity to said operative positions, and with said platform disposed with said one surface facing upwardly said pins are moved by gravity to said retracted positions; and (d) said openings being located a distance apart with respect to said first distance such that sliding movement of said platform in either direction will cause at least one of said pin means, in the operative position, to encounter a support member to prevent further sliding movement thereof.

2. Safety apparatus for scaffolds according to claim 1 wherein said hollow cylinder comprises an axial bore of first diameter and an open end of smaller diameter leading to said bore, and wherein said pin comprises an elongated shank portion corresponding in diameter to that of said open end and a larger diameter end portion disposed in said bore.

3. Safety apparatus for scaffolds according to claim 1 wherein each said hollow cylinder is sized to tightly fit within said corresponding opening, and wherein said open end is positioned substantially flush with said one surface.

4. Safety apparatus for scaffolds according to claim 1 wherein said openings in said platform are spaced apart a greater distance than said first distance.

5. Safety apparatus for scaffolds, comprising:

(a) a scaffold having a platform and at least a pair of generally horizontally extending support members beneath said platform spaced a first distance apart, said platform having opposing surfaces;

(b) a pair of openings in said platform through one surface spaced a second distance apart and extending generally normal to said one surface; and (c) safety means mounted within each said opening comprising a hollow housing having a stop member freely mounted therein for movement between a retracted position with respect to said one surface and an operative position extending out of said opening beyond said one surface such that with said platform disposed with said one surface facing downwardly said stop members are moved by gravity to said operative positions to prevent said platform from sliding off said support members, and with said platform disposed with said one surface facing upwardly said stop members are moved by gravity to said retracted positions.

6. Safety apparatus for scaffolds according to claim 5 wherein said openings in said platform are spaced longitudinally with respect to the platform such that a relatively short sliding movement of said platform in either direction will cause one of said stop members to engage a support member to prevent further sliding movements thereof.

7. Safety apparatus for scaffolds according to claim 5 wherein one of said pairs of support members and openings are positioned between the other pair.

8. In a scaffold having a platform with a support surface and an oppositely facing surface, and generally horizontally extending support members beneath said platform, the improvement comprising a generally vertically disposed opening in said oppositely facing surface of said platform and safety means mounted within said opening comprising a hollow housing having an elongated stop member mounted therein for movement between a retracted position with respect to said oppositely facing surface and an operative position extending out of said opening beyond said oppositely facing surface such that with said platform disposed with said support surface facing upwardly said stop member is moved by gravity to said operative position to engage a support member upon sliding movement of said platform, and with said platform disposed with said support surface facing downwardly said stop member is moved by gravity to said retracted position.

9. A scaffold platform having opposing surfaces, a pair of longitudinally spaced openings extending into said platform through one surface generally perpendicular to said one surface, and safety means mounted within each said opening comprising a housing having a bore with a stop member mounted therein for unrestricted movement between a retracted position within said bore and with respect to said one surface, and an operative position extending out of said bore beyond said one surface such that with said platform disposed with said one surface facing downwardly said stop members are moved by gravity to said operative positions, and with said platform disposed with said one surface facing upwardly said stop members are moved by gravity to said retracted positions.

* * * * *